United States Patent [19]

Parry

[11] Patent Number: 4,468,915

[45] Date of Patent: Sep. 4, 1984

[54] SATELLITE PACKAGING SYSTEM

[76] Inventor: John C. Parry, 6729 Brookmont Dr., Baltimore, Md. 21207

[21] Appl. No.: 326,146

[22] Filed: Nov. 30, 1981

[51] Int. Cl.[3] ..... B65B 11/04

[52] U.S. Cl. ..... 53/587; 53/211; 53/390

[58] Field of Search ..... 53/587, 588, 390, 391, 53/441, 210, 211; 414/65, 266, 607, 608, 663, 672; 108/20, 139; 248/349

[56] References Cited

U.S. PATENT DOCUMENTS

| | | | |
|---|---|---|---|
| 905,018 | 11/1908 | Sullivan | 108/20 |
| 1,553,528 | 9/1925 | Hartong | 108/20 |
| 3,757,977 | 9/1973 | Brudi | 414/607 |
| 4,050,221 | 9/1977 | Lancaster | 53/587 |
| 4,095,395 | 6/1978 | Goldstein | 53/210 |
| 4,166,589 | 9/1979 | Hoover | 53/390 X |
| 4,276,794 | 6/1981 | Olson | 414/663 |
| 4,282,700 | 8/1981 | Goldstein | 53/588 X |
| 4,344,727 | 8/1982 | Chaloupka | 414/65 X |

OTHER PUBLICATIONS

"E-Z Wrapper"-by Infra Pak-Jun. 1979.

*Primary Examiner*—John Sipos

*Attorney, Agent, or Firm*—Walter G. Finch

[57] ABSTRACT

The invention is an improved packaging system that may be located in satellite-like locations in a large area where packaging operations are being performed. The system combines the use of load carrying structures, such as pallets, load transporting equipment, such as pallet transporters, a turntable device, a mechanism for revolving the turn-table device, and a securing facility to package, by wrapping, a load upon the load carrying structure. The turn-table device consists of a plate-like platform secured to a bearing which is supported by a frame structure having rollers on which the plate-like platform revolves. The mechanism for revolving the turn-table device consists of a powered facility that turns a friction-type roller to revolve the plate-like platform. The load transporting equipment facilitates the movement and proper positioning of the turn-table device for placing a load upon the load carrying structure, and for coupling the turn-table device, on which the load carrying structure is located, to the mechanism for revolving the turn-table device. During the revolving of the plate-like platform of the turn-table device, the load is secured to the load carrying structure by wrapping it with stretch-type film material.

20 Claims, 9 Drawing Figures

SATELLITE PACKAGING SYSTEM

BACKGROUND AND SUMMARY OF THE INVENTION

The invention relates to packaging systems and in particular to packaging systems utilizing pallets and stretchtype film material. Specifically, the invention relates to a rotateable structure which carries a pallet, both of which are transported, during loading, by transporting equipment; the transporting equipment is also used to locate the rotateable structure in a precise position for rotating by mechanical means to facilitate securing the load to the pallet with stretchtype film material.

The loading of materials upon a pallet and subsequently securing the materials to the pallet in the prior art is a laborious task. In the prior art considerable time and labor is involved in loading materials on a pallet at a work station or in carrying materials from a plurality of locations, such as in a warehouse, to a pallet. In the prior art this loading procedure involves walking around the pallet to load each side or straining to reach over a pallet to load at the opposite side. This latter aspect is particularly dangerous where stock selectors are riding on elevated transport means. The present invention eliminates these difficulties and time consuming and dangerous procedures.

In the prior art the wrapping of loaded pallets with stretch film material to secure the load to the pallet has been done with the pallet in a stationary position that requires the operator to walk around the pallet. This procedure is time consuming, tiresome, and prohibits proper locking of the stretch film material to the pallet. The present invention eliminates these difficulties.

Huge, expensive machines have been developed in the prior art to rotate pallets for automatic wrapping of a load to secure it on a pallet. However, these machines are not easily relocated as loading requirements vary. Also, the operation is such that the proper locking of the stretch film material to the pallet is not accomplished. The present invention eliminates these problems; the present invention is small, and inexpensive in comparison to the aforementioned prior art machines.

The system of the present invention combines the use of load carrying structures, such as pallets, load transporting equipment, such as pallet transporters, a turn-table device, a mechanism for revolving the turn-table device, and a securing facility to package, by wrapping, a load upon a load carrying structure. The securing facility being a means such as stretch-film.

In the present invention, load transporting equipment, such as pallet transporters, are used to pick up a turn-table device. The load transporting equipment may be of the socalled "walkie" type or of the "ride-on" type.

It is to be noted that one type of securing facility and the means to apply it is the apparatus for application of plastics stretch film. The aforementioned apparatus, U.S. Pat. Nos. 4,179,081 and 4,248,392 were invented by the inventor of the present invention.

One or more pallets are then loaded on the turn-table device. The materials to be loaded, from a work position or by selection from storage points, are then loaded upon the pallet.(If more than one pallet is on the turn-table device the loading is made upon the top pallet). As will be described hereinafter, the rotating platform of the turn-table device may be turned manually to facilitate loading any side of the pallet on the turn-table device. This eliminates the need to walk around the pallet to load on the opposite side, or to strain to reach across the pallet.

When the pallet is loaded, the pallet transporter is used to transport the turn-table device and the loaded pallet on it, to a conveniently located mechnism for revolving the turn-table device so that the load may be secured to the pallet with stretch film.

As will be described hereinafter, the pallet transporter is used to locate the turn-table device in a precise position at the mechanism for revolving the platform of the turn-table device.

When the turn-table device is in position, the pallet transporter is removed and the rotateable platform of the turn-table device is automatically coupled to the rotating mechanism.

A foot switch is used to activate the rotating mechanism to rotate the platform of the turn-table device. As the platform rotates, the loaded pallet on it also rotates with it. Stretch film is applied as the loaded pallet rotates to secure the load to the pallet.

As will be described hereinafter, the platform of the turn-table device has several novel and unique features: the planar configuration exposes the corners of the pallet so that the stretch film can be locked to the underside of the pallet at the corners; slots are provided for anchoring the end of the stretch film in order to begin the wrapping procedure.

When the load is secured to the pallet by wrapping with the stretch film, the pallet transporter is used to remove the loaded and wrapped pallet from the turn-table device and set it aside for later collection and shipment. The pallet transporter is then used to pick up the turn-table device and another empty pallet to repeat the aforementioned process.

In the prior art, strapping of the load to the pallet with steel tapes was used. These tapes often permit the load to loosen during transport. The use of stretch film in the present invention has a tendency to tighten during transport.

It is to be noted that a plurality of operators can be utilized to operate a plurality of pallet transporters, each having a turn-table device, to load subsequent pallets. However, only one mechanism for revolving the platform of the turn-table device is required to service the plurality of operating combinations. The mechanism can be positioned in a convenient satellite-like location. In an extremely large operation, such as in a very large warehouse, several satellite-like mechanisms can be conveniently located to service a loalized group of operators and their pallet transporters and associated equipment.

It is, therefore, an object of this invention to provide a system to permit manual rotation of a pallet being loaded to facilitate loading the pallet.

It is another object of this invention to provide a system to rotate a loaded pallet while the load is being secured to the pallet.

It is also an object of this invention to provide a system that may be placed in a satellite-like position to service a plurality of separate satellite-like rotateable devices when loading pallets.

It is still another object of this invention to provide a system that permits anchoring the load securing material to the pallet.

It is yet another object of this invention to provide a system that has a facility to hold stretch-type film at one end until the packaging wrap can be started.

Further objects and advantages of the invention will become more apparent in the light of the following description of the preferred embodiments.

DESCRIPTION OF THE PREFERRED EMBODIMENTS

Figure 1:
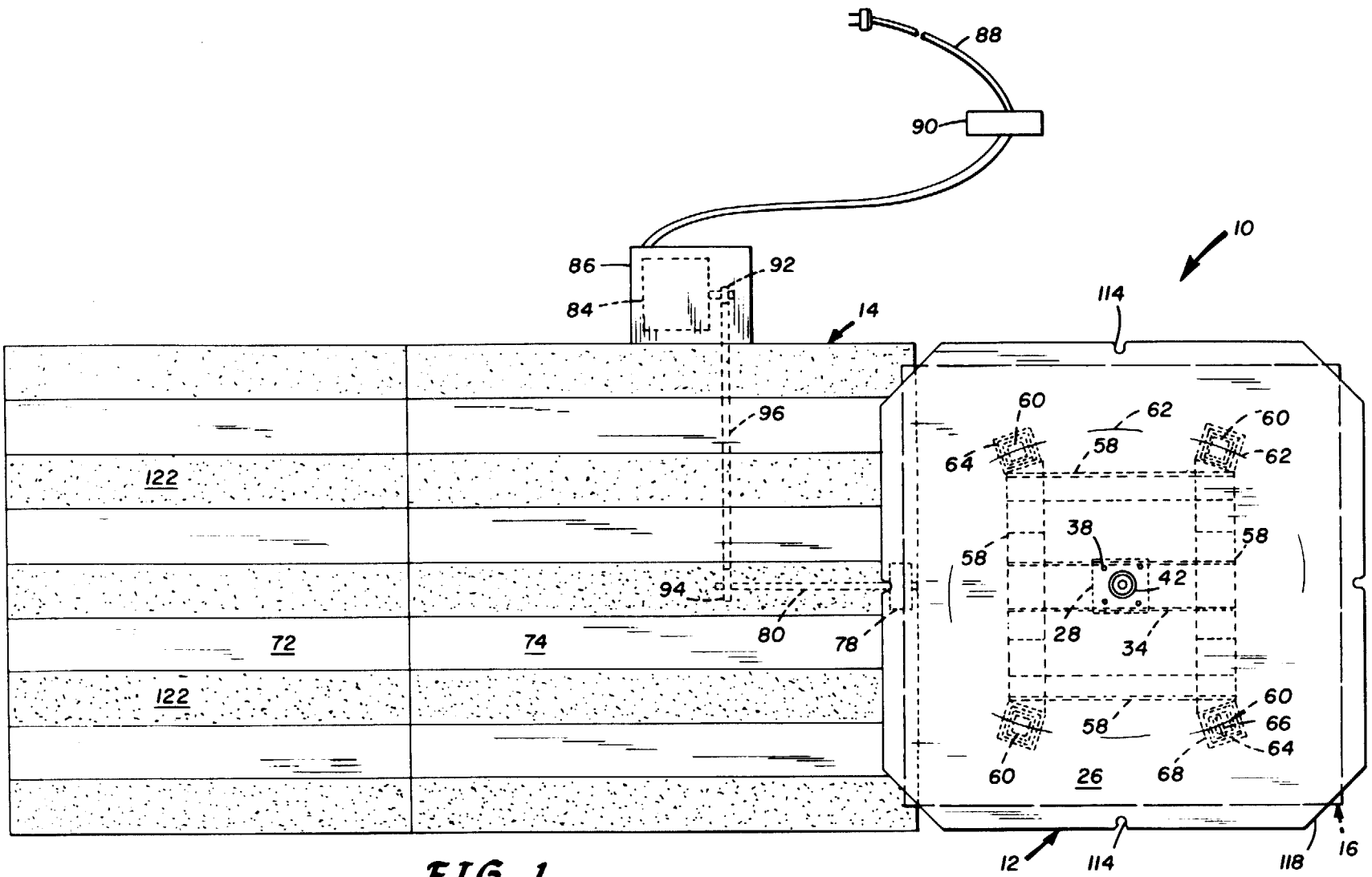
FIG. 1 is a plan view of a first embodiment of a satellite packaging system in operating position.
Figure 4:
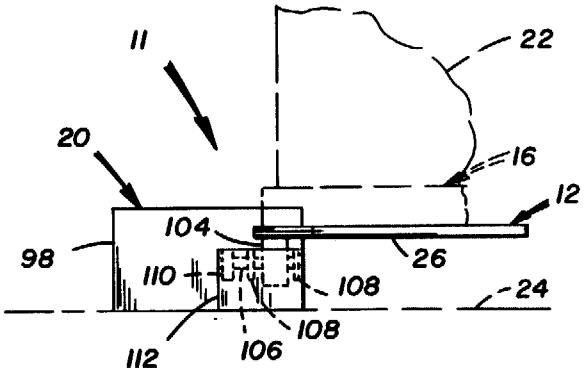
FIG. 4 is a side view of FIG. 3.
Figure 2:
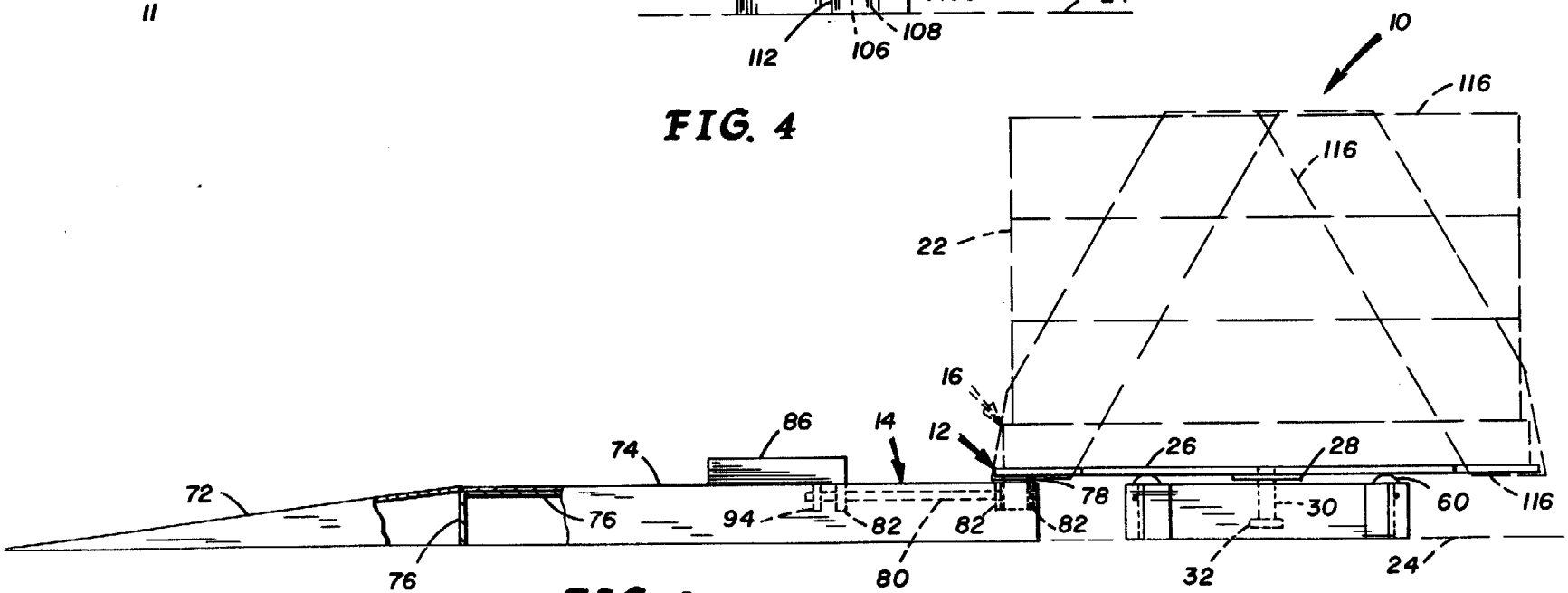
FIG. 2 is a side view of FIG. 1.
Figure 5:
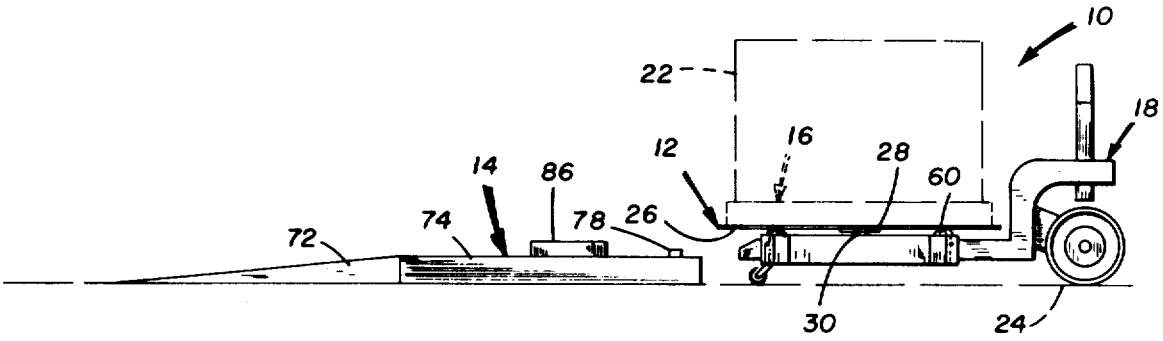
FIG. 5 is a side view of a first embodiment of a satellite packaging system showing a turn-table component in an approach position.

Referring now to the drawings and particularly to FIGS. 1, 2, and 5, portions of the components of a first embodiment of a satellite packaging system are shown at 10 as described hereinafter. Portions of the components of a second embodiment of a satellite packaging system 11 are shown in FIGS. 3 and 4 as described hereinafter.

The satellite packaging systems 10 and 11 consist of the combining of numerous components. The systems each combine the use of a load carrying structure 16 component, such as a pallet, a load transporting equipment means 18 component, such as a pallet transporter or fork-lift device, a turn-table device 12 component, a mechanism 14 component to revolve or operate component 12 in the first embodiment or a mechanism 20 component to revolve or operate component 12 in the second embodiment, and a securing facility 116 component, such as stretch film material, to package, by wrapping, a load 22 upon a load carrying structure 16 component.

Figure 3:
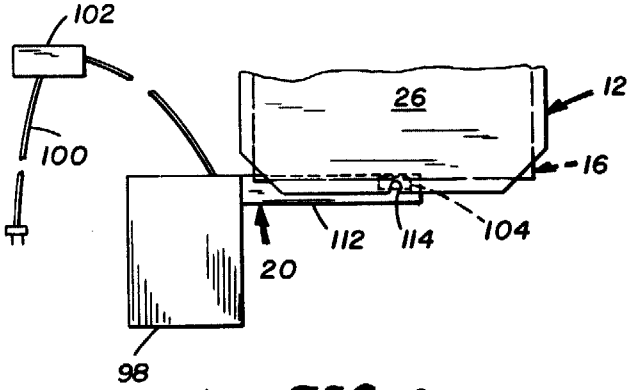
FIG. 3 is a partial plan view of a second embodiment of a satellite packaging system.

As noted hereinbefore portions of these components are shown in FIGS. 1, 2, 3, 4, and 5. FIG. 1 shows a plan view of components 12, 14 and 16. FIG. 2 shows a side view of components 12, 14, and 16, with a load 22 shown on the load carrying structure 16 component and with the securing facility 116 component shown affixing the load 22, shown in phantom lines, to the load carrying structure 16 component, also shown in phantom lines. FIGS. 3 and 4 show a portion of component 12 interfacing with component 20, and also in FIG. 4 a portion of a load 22 (in phantom lines) on a portion of component 16 (also shown in phantom lines). FIG. 5 shows a load transporting equipment means 18 component carrying component 12 in an approach to component 14 of the first embodiment. Note that the turn-table device 12 component is carrying a load 22 (shown in phantom lines) on component 16 (also shown in phantom lines). It is to be noted that the approach to component 20 of the second embodiment is done in the same manner.

A pallet transporter is illustrated as the load transporting equipment means 18 component. It is to be understood that component 18 may also be a fork-lift means or other similar load transporting means and such variation is within the scope and intent of this invention. It is also to be noted that these load transporting means 18 components may be of the "walkie" type or the "ride-on" type, such variations also being within the scope and intent of this invention.

To simplify the description of the components of the invention hereinafter, the term "pallet 16" will be used in reference to the load carrying structure 16 component, the term "transport means 18" will be used in reference to the load transporting equipment means 18 component, the term "turn-table 12" will be used in reference to the turn-table device 12 component, the term "revolving mechanism 14" (or 20) will be used in reference to the mechanism 14 (or 20) component, and the term "stretch film 116" will be used in reference to the securing facility 116 component.

In the operation of the satellite packaging systems 10 and 11 the arrangement is as described hereinafter. Depending upon whether the transport means 18 is a pallet type transporter or a fork lift truck, the latter with a capability of elevating the forks from floor level to a considerable height above the floor level, determines whether the system 10 or 11 or both are to be used.

The satellite packaging system 10 is used when the pallet type transporter is used. This is used so that the pallet type transporter can run up the ramp 72 and on to the platform 74, as seen in FIGS. 1 and 2, to remove a pallet 16 which has a load 22 secured to it with stretch film 116. It is to be noted that the satellite packaging system 10 can also be used where the fork lift truck is used as the transport means 18 if the ramp 72 and the platform 74 have been constructed to carry the very heavy weight of the fork-lift truck.

The satellite packaging system 11 is used when the fork-lift truck is used as the transport means 18 and the ramp 72 and plafform 74 is not of sufficient strength to carry the fork-lift truck.

It is also possible to utilize both satellite packaging systems 10 and 11 when the transport means 18 comprises transport vehicles of both types.

In the operation of the satellite packaging system 10 or 11, the system operates with one or more revolving mechanisms 14 or 20 (or a combination of both as noted hereinbefore) located as a base "satellite" around which the other operations take place. For purposes of explanation and illustration a supply warehouse will be used in which operators, acting as "stock selectors", move about the warehouse with a pallet 16 on a transport means 18 and select stock at numerous locations to make up an order. The pallet loads for each order are then taken to a central location for strapping (in the prior art) of the load to the pallet for subsequent shipment. If the warehouse is small, a single base "satellite" location as described above, might be used. If the warehouse is large, several base "satellite" locations may be used to improve efficiency.

It is also to be noted that the turn-table 12 and the other components of the system may also be used with a so-called "stock selector" truck on which the operator is elevated with the pallet for stock selection at various heights. The rotatable turn-table improves the safety on this type truck by reducing the "reach" required to load the pallet, as described hereinafter.

For each base "satellite" location of a revolving mechanism 14 or 20 (or both) a plurality of transport means 18 and a plurality of pallets 16 will normally be used (one combination for each stock selector working), and one turn-table 12 for each transport means 18. The turn-table 12 is carried by the transport means 18 as a floating "satellite" location for loading pallets, as shown in FIG. 5. One or more pallets 16 are placed on the load bearing plate 26 of the turn-table 12. The loading of more than one pallet 16 on the turn-table 12 for sequential loading of each pallet 16, in turn, reduces the time required for picking up a pallet 16 to begin each operation. The description of the operation will be given for a single pallet 16 for purposes of clarity.

In placing the pallet 16 on the load bearing plate 26 of the turn-table 12, the corners of the pallet 16 are so placed that each corner overhangs the cut-off corners 118 of the load bearing plate 26, as can be seen in FIGS. 1 and 3. This is for the purpose of providing access for hooking the stretch film 116 under the corners of the pallet 16 when the load 22 is secured to the pallet 16 with the stretch film 116.

As the items to be packaged on the pallet 16 are selected, the operator arranges them in a proper loading pattern on the pallet 16. As one side of the pallet is loaded it is to be noted that the operator never needs to reach beyond the center of the pallet. The operator merely turns the load bearing plate 26 (as a "turntable") manually (by using hand or foot) until the next side of the pallet 16 is convenient to be reached. The flange mount pillow block bearing 28 makes this movement easy, as will be described regarding the assembly hereinafter. This feature adds to the safety of operators using the so-called elevating "stock selector" trucks as mentioned hereinbefore.

When a load 22 on a pallet 16 has been completed as a "floating" satellite for stock selection, as seen in FIG. 5, the transport means 18 is used to bring its load to the revolving mechanism 14 (or 20) at the base satellite location. The turn table 12, pallet 16, and load 22 is brought to the end of the revolving mechanism 14 (or 20) as seen in FIG. 5, and then positioned as shown in FIG. 1 (or FIG. 3) so that one side of the load bearing plate 26 of turn-table 12 overhangs the revolving mechanism 14 (or 20). Note that the overhanging side of load bearing plate 26 is over the revolving drive wheel 78 (or 104 in the second embodiment).

When the transport means 18 lowers its load to the floor level 24, elements of the support frame members 58, including support member 34, come to rest on the floor 24. At the same time, the underside of load bearing plate 26 comes to rest on top of and interfaces with the revolving drive wheel 78 (or 104). The loaded pallet 16 is now ready to have the stretch film material 116 applied to secure the load 22 to the pallet 16.

To revolve the load bearing plate 26, of the turn-table 12, with the loaded pallet 16, the operator uses the control means 90 (or 102), which may be a foot switch means so that the operator's hands are free to apply the stretch film 116. The details of the structure that turns or revolves the revolving drive wheel 78 (or 104), when the central means 90 (or 102) is activated, is described hereinafter. As the revolving drive wheel 78 (or 104) turns, the interface with the underside of the load bearing plate 26 causes the load bearing plate 26, with its loaded pallet, to revolve about its center.

Before the operator activates the control means 90 (or 102), the operator gathers together the end of the stretch film 116 and hooks or anchors it into one of the notches 114 (one on each side of the load bearing plate 26). With the stretch film 116 so anchored, the control means 90 (or 102) is activated and as the load bearing plate 26 and its loaded pallet 16 revolves the operator guides the stretch film 116 over and around the loaded pallet 16 to completely secure the load 22 to the pallet 16. Part of the wrapping is brought down, under, and around the corners of the pallet 16 where they extend beyond the cutoff corners of the bearing plate 26. Thus, the load is securely affixed to the pallet.

It is to be noted that in using stretch film 116 in this manner, the wrapping actually tightens as the load vibrates in subsequent transit, because the stretch film 116 is actually stretched by pulling as it is wrapped around the load 22, and draws tighter under vibration due to the "memory" in the stretch film.

Where more than one pallet 16 is loaded on the turntable 12, as mentioned hereinbefore, the pallets 16 are staggered slightly so that the corners are free of the pallet below and exposed to facilitate hooking the stretch film 116 under the corners as described hereinbefore.

The transport means 18 can now be removed from under the turn-table 12 and taken to the opposite side of the revolving mechanism 14 (or 20) to remove the loaded and secured pallet 16 for subsequent shipment. An alternative is to use a separate transport means 18 to remove the loaded and secured pallet 16. After removal of the loaded and secured pallet 16, the transport means 18 is raised under the turn-table 12 and, with another pallet 16 in place on the load bearing plate 26, the process of loading the pallet 16 and subsequently securing the load with stretch film 116 is repeated.

Regarding the application of the stretch film 116, the satellite packaging systems 10 and 11 make use of the apparatus for application of plastics stretch film as covered by U.S. Pat. Nos. 4,179,081, issued Dec. 18, 1979, and 4,248,392, issued Feb. 3, 1981 to John C. Parry, the inventor of the satillite packaging systems 10 and 11.

Turning now to a discussion of the structures of the turn-table 12, and the revolving mechanisms 14 and 20, the turn-table 12 is used with both of the revolving mechanisms 14 and 20. The turn-table 12 structure will be discussed first.

The turn-table 12 consists of load bearing plate 26, a flange mount pillow block bearing 28, a clamping shaft 30 affixed to a base 32, and supported by a support member 34, a combination of support frame members 58, a plurality of wheel or roller support members 60, and a plurality of support means 64 for the plurality of wheel or roller support members 60. The relation of the aforementioned elements of the turn-table 12 component to each other and their cooperation with each other is discussed hereinafter. The details of the aforementioned elements are shown in FIGS. 6, 7, 8, and 9.

Flange mount pillow block bearing 28 is centrally located and affixed to the underside load bearing plate 26 with a plurality of countersunk bolts and nut means 38. The countersunk bolt means 38 pass through countersunk holes 52 in load bearing plate 26 and through mounting holes 54 in flange mount pillow block bearing 28.

The load bearing plate 26 has a centrally located aperture 44 through it. The central shaft opening 46 through the flange mount pillow block bearing 28 is axially aligned with the aperture 44 in the load bearing plate 26 when it is affixed to the load bearing plate 26 as aforementioned.

A clamping shaft 30 affixed to, or integral with, a base 32 is affixed to a central support member 34. The clamping shaft 30 and its base 32 are affixed to the central support member 34 by a plurality of bolt and nut means 36 which pass through holes 48 in the base 32 and holes 50 in the central support member 34. The central support member 34 rests upon the floor 24.

Figure 6:
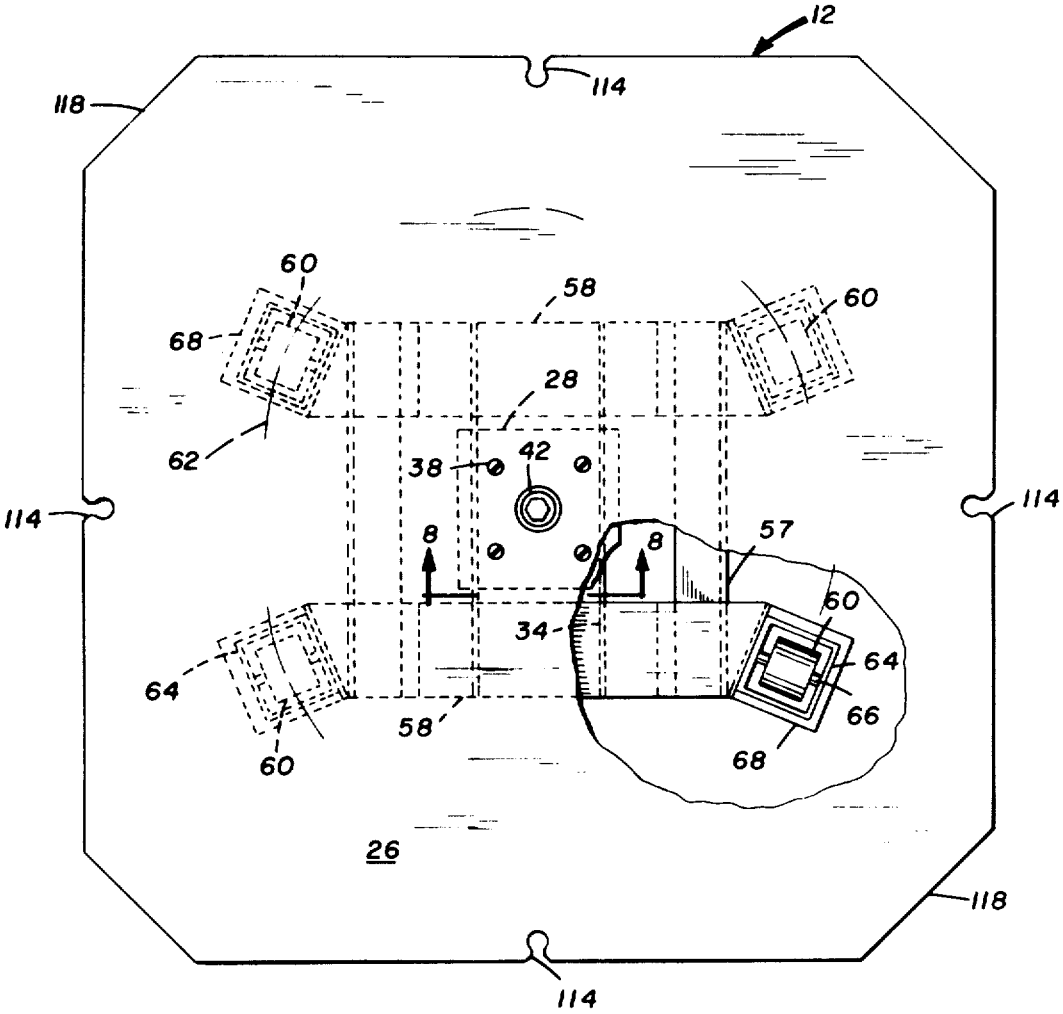
FIG. 6 is an enlarged plan view of the turn-table component of FIG. 1.
Figure 7:
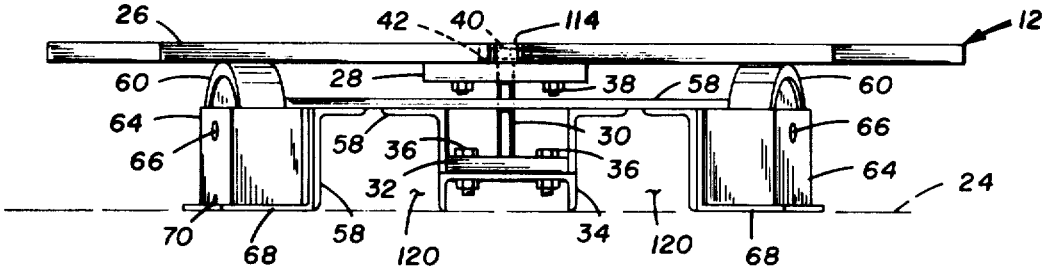
FIG. 7 is an end view of FIG. 6.
Figure 8:
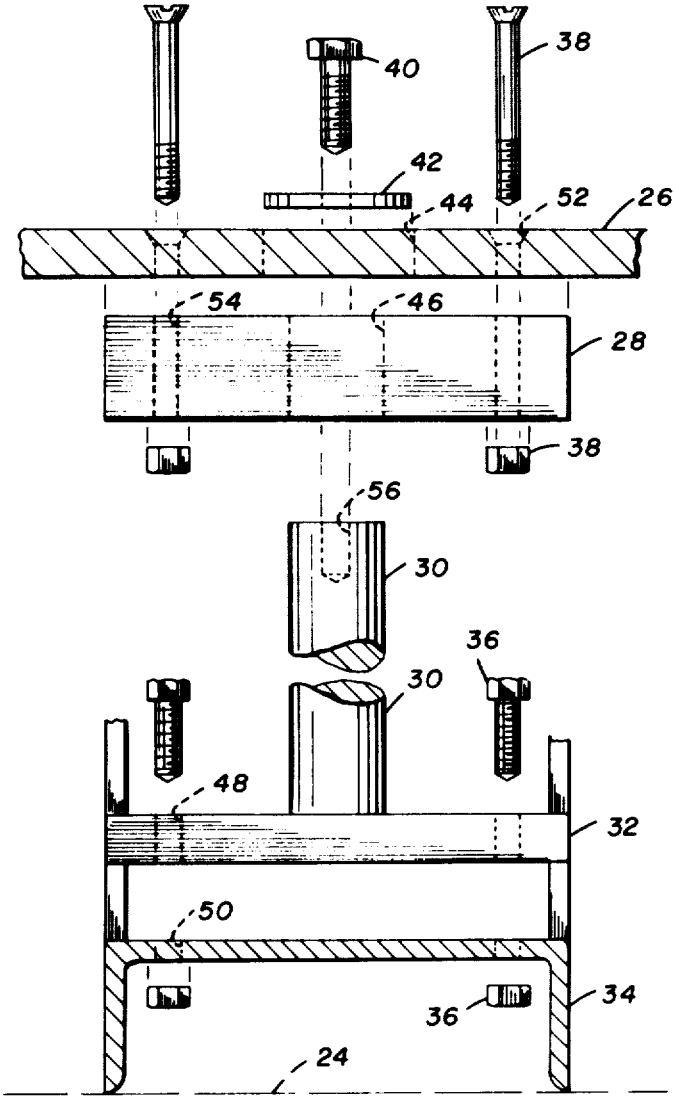
FIG. 8 is an enlarged partial exploded sectional view of the center structure of the turn-table component of FIG. 6 on line 8—8.
Figure 9:
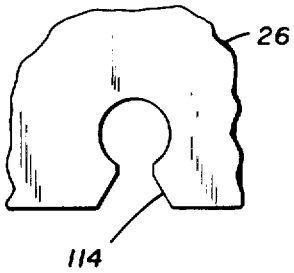
FIG. 9 is an enlarged plan view of an anchor slot for stretch-film in the turn-table component of FIG. 6.

In addition to the central support member 34, a plurality of support frame members 58 are affixed to each other and to central support member 34 to provide an undercarriage for the turn-table 12. The arrangement of the plurality of support member 58 is shown in FIGS. 6 and 7. Portions of the support members 58 rest upon the floor 24, similar to the central support member 34. The arrangement of a portion of the support members 58 is arranged to form pocket-like passageways 120 through the undercarriage arrangement. These pocket-like passageways 120 provide space for the forks of a transport means 18, such as the forks of a pallet transporter or a fork-lift truck, to pass through and lift the turn-table 12.

Horizontal plate-like bases 68 are affixed to the support frame members 58 at floor level and extend outwardly from the support frame members 58.

A plurality of wheel or roller support members 60 are each mounted in support means 64 which are then affixed to the horizontal plate-like bases 68. The wheel or roller support members 60 are mounted in support means 64 by a shaft means 66. The wheel or roller support members 60 provide a more or less friction free or minimum of friction between said support members 60 and said load bearing plate member 26.

The underside of the load bearing plate 26 rests upon and is supported by the plurality of wheel or roller support members 60. The elevation positon of the support means 64 and the wheel or roller support members 60 in each is such that the uppermost surface of each of the plurality of wheel or roller support members 60 is in the same horizontal plane.

As the load bearing plate 26 rests on and is supported by the wheel or roller support members 60 and when the load bearing plate 26 is so oriented that the shaft opening 46 is axially aligned with the clamping shaft 30, the clamping shaft 30 will extend upward into the shaft opening 46. The uppermost end of the clamping shaft 30 is slightly lower than the underside of the load bearing plate 26 so that when fastening means 40 is passed through clamping washer 42 and screwed into threaded hole 56, the clamping washer 42 bears against the topmost surface of the collar of the shaft opening 46 and pulls the load bearing plate 26 down snugly upon the wheel or roller support members 60.

As noted hereinbefore, the corners 118 of the load bearing plate 26 are cut off to expose the corners of the pallet 16 to facilitate attachment of the stretch film 116 when securing a load 22 to the pallet 16.

Also, as noted hereinbefore, a notch 114 is cut into each side of the load bearing plate 26 as means for an initial anchoring of the stretch film 116 in order to start the wrapping operation. When the pallet 16, with its secured load 22 attached to it by the stretch film 116, is lifted from the turn-table 12 the end of the stretch film 116 in the notch 114 pulls out easily or tears off.

The wheel or roller support members 60 are set so as to ride on the underside of the load bearing plate 26 in a circular path as indicated by the line 62.

It is to be noted that the support means 64 for the wheel or roller support members 60 are shown as being more or less hollow and rectangular in configuration. Other configurations of means of support to hold the wheel or roller support members 60 are within the scope and intent of this invention.

A drain hole 70 is shown in the base of the support means 64. The drain hole 70 provides a means for eliminating liquids from the support means when the turn-table is used in wet environments, such as in food processing plants.

Turning now to the detailed structures of the revolving mechanisms 14 and 20, the details are shown in FIGS. 1, 2, 3, and 4. The revolving mechanism 14 for the first embodiment, and the revolving mechanism 20 for the second embodiment are similar in operation, the similarities will be noted in the description. Both serve the same purpose, to revolve the load bearing plate 26 of the turn-table 12, and include provisions for providing access of a transport means 18 to lift a loaded and secured pallet 16 from the turn-table 12.

The revolving mechanism 14, shown in FIGS. 1 and 2, consists of a ramp 72, a platform 74, a power means 84, such as an electric motor, a power source 88, such as an electrical cord and plug for an electric motor, a friction type revolving drive wheel 78, and mechanical drive transmission means described hereinafter.

The ramp 72, and the platform 74 are for the purpose of providing access for pallet-type transport means 18 to remove the loaded and secured pallet 16 from the turn-table 12. A suitable support frame 76 is provided within the ramp 72 and paltform 74. The ramp 72 and platform 74 may also be used by the heavier fork lift trucks if the support frame 76 has sufficient strength to carry the load.

From the motor 84, in housing 86, a pinion 92 drives a chain 96, which in turn drives a gear 94 on drive shaft 80, which turns the revolving drive wheel 78. The revolving drive wheel 78 is of a composition to provide a good frictional contact at the interface with the underside of load bearing plate 26. The drive shaft 80 is supported by bearings 82.

It is to be noted and understood that although the aforementioned description refers to a pinion 92, chain 96, and gear 94, that a belt and sheave combination, a direct gear drive, or other means known in the art are within the scope and intent of this invention.

The revolving mechanism 20 for the second embodiment is similar to that described hereinbefore for the first embodiment. The second embodiment omits the ramp 72 and the platform 74 structure, these are not required when only fork lift trucks, with elevating forks, are used to remove loaded and secured pallets 16 from the turn-table 12. The forks can be elevated to lift the pallet 16 while the fork lift truck is on the floor.

With no platform 74 or ramp 72, the power equipment to turn the revolving drive wheel 104 can be located in a more compact manner. FIGS. 3 and 4 show one such arrangement. It is to be understood that variations in the arrangement and structure to drive the friction type revolving drive wheel 104 is within the scope and intent of this invention.

The power system of the second embodiment 11, revolving mechanism 20, is similar in many respects to that of revolving mechanism 14. A motor housing 98 (similar to housing 86) enclosing a motor (not shown) similar to motor 84, a power source 100 (similar to power source 88), a control means 102 (similar to control means 90), a drive shaft 106, bearings 108 and a drive gear 110 are similar to those in the first embodiment. The structure includes a pinion and drive chain (not shown) similar to that in the first embodiment, likewise, it is to be understood that the drive mechanism may be varied as noted for the first embodiment. For safety, the drive mechanism is enclosed in a housing 112.

It is to be noted and understood that the revolving mechanism 20 may be a direct drive unit set directly in front of the revolving drive wheel 104 and having the revolving drive wheel 104 mounted directly on the drive shaft of the motor. In this case the secured load 22 on the pallet 16 may be removed by a fork lift from either of several sides of the turn-table 12.

At the friction type revolving drive wheel 78 (or 104) shims are placed under the pillow-block bearings 82 (or 108 respectively). As the interface surface of the revolving drive wheel 78 (or 104) wears, shims are removed from under the bearings 82 (or 108) which has the effect of raising the interface surface of the revolving drive wheel 78 (or 104) to its original level or horizontal plane.

In a similar manner, as the wheel or roller support means 60 wear, shims are added under the support means 64. This has the effect of raising the interface surface to its original plane of interface contact with the underside of the load bearing plate 26.

The use of shims, as noted hereinbefore, can be practiced until it is necessary to replace the wheels 60, 78, or 104. The revolving drive wheels 78 and 104 are of the friction type to provide a good interface contact between the wheel surface and the underside of the load bearing plate 26. The wheel or roller support members 60 are similar to industrial casters and may be plastics, steel, rubber, or other composition.

Regarding the speed of turning the load bearing plate 26, the speed can be varied by the location of the edge of the side of the load bearing plate 26 in relation to the revolving drive wheel 78 (or 104). The closer to the edge of the load bearing plate 26, the slower the speed (revolutions per minute); the closer to the center of the load bearing plate 26, the faster the speed (revolutions per minute).

Adjustment of the speed is desirable when light loads 22 are loaded on the pallet 16. If the speed is too high, the light loads have a tendency to move outwardly, due to centrifugal force, before the stretch film 116 can be put in place. An alternative for adjusting the speed is to include a speed variation means (not shown) at the motor 84.

To facilitate smooth operation, a non-slip surface, such as a rubber pad or other similar material may be applied to the top surface of the load bearing plate 26 upon which the pallet 16 is placed.

To improve traction on the ramp 72 and platform 74, strips of non-skid material 122 may be applied to the top surface; as an alternative, the entire surface of the ramp 72 and platform 74 may be covered with the non-skid material 122.

It is to be noted and understood that instead of the manual application of the stretch film 116 to secure a load 22 on a pallet 16, that a mechanical means may be used to pay out the stretch film 116, stretching it taut, and moving vertically with it in overlapping layers. Such a mechanical means, not shown, would be synchronized with the power drive means and the revolving turn-table 12, and located at a point adjacent to the turn-table 12 and at or near the revolving mechanism 14 (or 20).

As can be readily understood from the foregoing description of the invention, the present structure can be configured in different modes to provide the ability to serve as a satellite packaging system or the various components of the system.

Accordingly, modifications and variations to which the invention is susceptible may be practiced without departing from the scope of the appended claims.

What is claimed is:

1. A satellite packaging system, comprising:

at least one rotating power means, said rotating power means being located in a work area associated with packaging, said rotating power means serving as a base satellite position;

a plurality of material collecting means, each material collecting means of said plurality of material collecting means having a transport means, and a turn-table means for supporting a load carrying structure placed upon, supported by, and carried on each said turn-table means, each said turn-table means being placed upon, supported by, and carried on its respective transport means, each said turn-table means having a revolvable plate structure revolvable manually while said turn-table means is being supported by its respective transport means, said load carrying structure serving to carry a predetermined load of a quantity of materials to be packaged when assembled upon said load carrying structure and being supported by said turn-table means on said transport means, said revolvable plate structure having an undersurface for positioning and resting upon said rotating power means, said rotating power means providing motive power to turn said revolvable plate structure, said plurality of material collecting means being located in said work area, each material collecting means of said plurality of material collecting means serving as a floating satellite position that receives said material and sequentially moves the revolvable plate onto said power means;

wrapping means at said power means having a quantity of wrapping material for wrapping said wrapping material around each said predetermined load of said quantity of materials to be packaged to secure said predetermined load of said quantity of materials to be packaged to its respective load carrying structure, while said motive power turns said revolvable plate structure on said turn-table supported by said transport means.

2. A satellite packaging system as recited in claim 1, wherein said means for providing motive power to turn a revolvable plate structure consists of:

a motor means, said motor means having and being connected to a power source;

a drive wheel means, said drive wheel means interfacing with said revolvable plate structure;

a power transmission means, said power transmission means being affixed in position between said motor means and said drive wheel means, said power transmission means transmitting motive power from said motor means to said drive wheel, said drive wheel rotating said revolvable plate structure;

a control means, said control means being connected to said motor means, said control means having a capability of turning on and off said power source to said motor means.

3. A satellite packaging system as recited in claim 2, wherein said motor means is an electrical motor and said power source is an electrical power system, said connection to said power source being an electrical connection.

4. A satellite packaging system as recited in claim 2, wherein said drive wheel means has a friction-type surface to interface with said revolvable plate structure.

5. A satellite packaging system as recited in claim 2, wherein said power transmission means is a pinion, gear, chain and shaft system.

6. A satellite packaging system as recited in claim 2, wherein said power transmission means is a sheave, belt, and shaft system.

7. A satellite packaging system as recited in claim 2, wherein said power transmission means is a gear train system.

8. A satellite packaging system as recited in claim 2, wherein said control means is a foot control switch.

9. A satellite packaging system as recited in claim 2, and additionally, a ramp and platform structure, said ramp and platform structure housing said drive wheel means and said power transmission means, said ramp and platform top surface having a non-skid surface affixed thereto, said ramp and platform providing means of access for transport means to remove said load carrying structure with said packaged load secured thereon from said turn-table means.

10. A satellite packaging system as recited in claim 1, wherein said transport means is a pallet transporter.

11. A satellite packaging system as recited in claim 1, wherein said transport means is a fork lift truck.

12. A satellite packaging system as recited in claim 1, wherein said load carrying structure is a pallet.

13. A satellite packaging system as recited in claim 1, wherein said turn-table means consists of said revolvable plate structure, a flange mount bearing means, and a support structure, said flange mount bearing means being affixed to said revolvable plate, said bearing means providing free movement to said revolvable plate when rotating, said support structure being so constructed so as to hold said revolvable plate in a horizontal plane, provide access means for lifting by said transport means, and provide a means for resting said turntable structure on a surface such as a floor.

14. A satellite packaging system as recited in claim 13, wherein said support structure of said turn-table means is equipped with a plurality of spaced wheel-like means to provide a minimum friction support as said revolvable plate structure rotates thereupon.

15. A satellite packaging system as recited in claim 1, wherein said wrapping material is a stretch film material.

16. A satellite packaging system as recited in claim 13, wherein said revolvable plate structure has a plurality of notches in the edges thereof, said notches being used to anchor the end of said wrapping material prior to wrapping around said materials to be packaged.

17. A satellite packaging system as recited in claim 13, wherein the corners of said revolvable plate are cut off, said cut off corners providing a means for locating corners of said load carrying structure so as to extend therebeyond to facilitate attaching said wrapping material thereto to secure said predeterminated loads of materials to said load carrying structures.

18. A satellite packaging system as recited in claim 2, wherein the relation of the position of said revolvable plate structure is variable in relation to said drive wheel means so as to vary the rotating speed of said revolvable plate.

19. A satellite packaging system as recited in claim 2, and additionally, a plurality of shims, said shims being used to adjust the elevation of said drive wheel means as said drive wheel interfacing surface wears.

20. A satellite packaging system as recited in claim 14, and additionally, a plurality of shims said shims being used to adjust the elevation of said spaced wheel-like means as said spaced wheel-like means interfacing surface wears.

* * * * *